US006471606B1

(12) United States Patent
Simpson

(10) Patent No.: US 6,471,606 B1
(45) **Date of Patent: *Oct. 29, 2002**

(54) DEVICE FOR CREATING BALL SPINS

(76) Inventor: Alan Hood Simpson, 20 Merion Ct., Dover, DE (US) 19904-2319

( * ) Notice: Subject to any disclaimer, the term of this patent is extended or adjusted under 35 U.S.C. 154(b) by 0 days.

This patent is subject to a terminal disclaimer.

(21) Appl. No.: 09/591,859

(22) Filed: Jun. 12, 2000

(51) Int. Cl.[7] ..... A63B 69/00; A63B 67/00; A63B 59/10; A63H 17/02; A63H 17/045

(52) U.S. Cl. ..... 473/451; 473/558; 473/415; 446/23; 446/6

(58) Field of Search ..... 446/236, 240, 446/266, 484; 273/412; 473/422, 514, 509, 569, 451, 424, 426, 596, 558; 434/247

(56) References Cited

U.S. PATENT DOCUMENTS

| | | | | | |
|---|---|---|---|---|---|
| 2,935,321 | A | * | 5/1960 | Lhotka | 473/558 |
| 3,152,803 | A | * | 10/1964 | Sain, Jr. | 473/424 |
| 3,545,126 | A | * | 12/1970 | Brown | 446/236 |
| 5,045,014 | A | * | 9/1991 | Harkins | 446/236 |
| 5,261,851 | A | * | 11/1993 | Siebert, Jr. | 446/236 |
| 5,830,091 | A | * | 11/1998 | Romanick | 473/451 |

* cited by examiner

*Primary Examiner*—Paul T. Sewell
*Assistant Examiner*—Mitra Aryanpour

(57) ABSTRACT

A ball spinning device which has one or more balls, each ball having the surface appearance of a baseball. For an embodiment that has more than one ball, all balls are positioned in a straight line by connecting spindles. A power transferring spindle is sized and shaped so it can be connected to an electric motor which is capable of spinning the device at the same speeds as those of pitched baseballs. For each ball, its axis of rotation relative to its seam is determined by where spindles are joined to the ball with respect to its seam.

12 Claims, 2 Drawing Sheets

DEVICE FOR CREATING BALL SPINS

CROSS REFERENCES TO RELATED APPLICATIONS

This application is related to application Ser. No. 08/620,256, filed Mar. 22, 1996.

FEDERALLY SPONSORED RESEARCH OR DEVELOPEMENT

Not Applicable

BACKGROUND OF THE INVENTION

1. Field of Invention

The operation of this invention creates a spin on balls. Those balls that are spun, look like baseballs. The spin that is created when the invention is properly operated is the same spin as the spin for a particular type of pitch.

2. Description of Prior Art

A pitched baseball spins according to the type of pitch which has been thrown. Different types of pitches include fastball, curve ball, and slider. Although how the baseball spins can vary from pitcher to pitcher, there is a manner in which the baseball spins that can be considered typical for each type of pitch. Being able to recognize what is typical for each type of pitch, helps the batter to know what to look for when he is reading the spin of a pitched baseball. When a batter can read the spin of the pitched baseball, he knows what type of pitch is coming and he can better adjust his swing for the type of pitch. Baseball Hall of Fame member Rod Carew describes in his book how to read the spin of a baseball and the advantages of doing so. (Rod Carew, Art and Science of Hitting 51–55 (Penguin Books 1986)).

The spin on a pitched baseball has four defining characteristics:

- the spin's axis of rotation relative to the ball's seam position;
- the tilt of that axis away from being parallel to the ground;
- the revolutions per minute of the spin; and
- the spin direction (backspin versus top spin).

The conventional method to practice reading the spin of a pitched baseball requires a pitcher to pitch a ball to a catcher. Therefore the conventional method has the following disadvantages:

- A catcher is needed to usually stop the ball's flight
- A backstop is needed to sometimes stop the ball's flight
- For safety, an area surrounding the ball's flight must be kept vacant; therefore, the activity must take place in a large area, usually outdoors
- For safety, the ball's flight prohibits more than one batter standing in a batter's box at the same time
- To catch (or to retrieve) and to throw back the pitched ball takes time
- There must be enough skilled pitchers able to throw enough pitches for all the practicing batters.

SUMMARY OF THE INVENTION

The objective of this invention is to create the spin of a pitched baseball (or a pitched softball), and to create the spin without having to pitch the ball. Providing the spin will allow the batters to practice reading the spin of a pitched ball. However, because the spin is provided without the ball being pitched, all the disadvantages I have listed for the conventional method of practice, would be eliminated. An additional objective is that the invention creating the spin, can be made inexpensively.

This invention contemplates utilizing the spinning motion created by an electric motor, to spin balls. The balls that are spun look like baseballs. The spin on each ball is the same spin as the spin is for a particular type of pitch (fastball, curveball, or slider), when the invention is properly operated.

The invention is embodied by:

- balls which look like either baseballs or softballs;
- a power transferring spindle to transmit rotation from an electric motor to the balls;
- a connecting spindle or spindles to hold the balls in proper position while they spin;
- a means to join spindles to balls;
- specific and intended or purposeful locations where spindles meet balls' surfaces to create spins with specific and intended or purposeful axes of rotation.

DETAILED DESCRIPTION OF THE INVENTION

REFERENCE NUMERALS IN THE DRAWINGS

Figure 1:
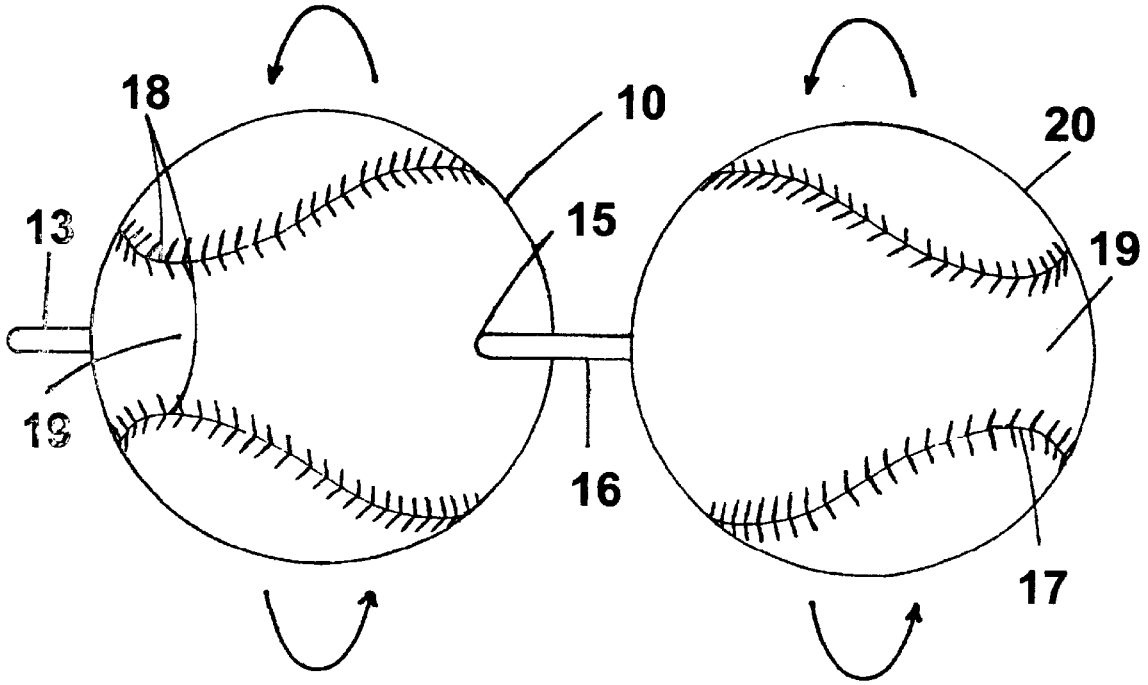
FIG. 1—Device with Plurality of Balls

10. Hollow plastic ball that is Nearest an Electric Motor when Device is Operated
11. Seam
12. Covering Material
13. Power Transferring Spindle
14. Spindle Location of Thrown against the Seams
15. Spindle Location of Thrown with the Seams
16. Connecting Spindle
17. Where Seams Turn or Change Direction
18. One Pair where Seams Turn or Change Direction
19. Midpoint of Most Narrow Width of Covering Material
20. Hollow plastic ball Joined Only to Connecting Spindle
21. Electric Motor

DESCRIPTION OF PREFERRED EMBODIMENT

Making the device requires joining a power transferring spindle to a ball. The power transferring spindle 13 transfers rotation from an electric motor to the ball nearest an electric motor when the device is operated 10. Additional balls 20 are connected as part of the device by connecting spindles 16, each connecting spindle joined to two balls. That is, each end of a connecting spindle is joined to a ball. The type of ball and the type of spindles that are part of the device are described below under the heading BALLS and under the heading SPINDLES. There are also specific and intended or purposeful locations where a spindle meets a ball's surface. Details of such locations are described under the heading LOCATIONS WHERE SPINDLES MEET SURFACES OF BALLS.

1. Balls (Refer to FIG. 1)

The following is a description of each ball that is part of this preferred embodiment. The ball 10 or 20 is round and has the surface appearance "a baseball". The surface of a baseball consists of two pieces of covering material 12 which are usually white. These two pieces of covering material 12 are sewn together with thread which is usually red. The continuous path where the two pieces of covering material are sewn together, is known as the seam 11. However, lengths of continuous seam which go in different directions are often considered different seams. Therefore a baseball is often thought of as having seams, rather than just one seam. The covering material has words printed on it which are usually black or blue. Therefore, for a ball 10 or 20 to have surface appearance of a baseball, the ball's surface must be within the above description.

For a ball to have the surface appearance of a baseball would not limit the ball to use or have the same surface material as a baseball. Preferably, the ball's surface is not sewn together and is one piece of material. Preferably the ball's surface material is all plastic. Therefore, the ball's surface is less expensive to make than the surface of a real baseball. However, it is necessary that whatever is used to give the appearance of a seam, to look and to follow the same path along the surface of a ball as the seam on an actual baseball would. Throughout the specifications and claims, the part of the ball surface that gives the appearance of a seam, shall be referred to as a seam. This will be so even if the seam is not made by sewing pieces of covering material together.

It costs less to make a ball used in this invention, than to make a baseball. There is no reason to make the balls of this invention with material that can withstand being hit with a baseball bat. Therefore hollow plastic balls are the preferred embodiment. The balls are made with lightweight material, so they can be made cheaper and they have less weight which needs to be supported during its use.

2. Spindles (Refer to FIG. 1)

The following is a description of the spindles or small diameter shafts which are part of this invention. The power transferring spindle 13 is sized and shaped so that it can be connected to an electric motor capable of inducing the same revolutions per minute as those of pitched baseballs. This connection can be made to the motor through a coupling or pulley. The connecting spindles 16 and the power transferring spindle 13 shall be made inconspicuous. A spindle shall be made inconspicuous by making the spindle as small as its support function allows and by making it of transparent material or making it an inconspicuous color relative to common or provided backgrounds. Therefore surface colorings of spindles and balls are different, even if both are made of the same material. All spindles are straight.

The spindles need only be long enough to keep the balls far enough a part that when the device is being used, a person trying to observe the spin on one ball is not distracted by the nearness of other balls which are part of the device. Spindles of lengths that keep the balls about one half ball diameter apart will accomplish this.

The bending along the device's axis of rotation must not be visible to the person practicing on the device or the spinning of the balls will not accurately simulate thrown pitches.

However, when the device is connected to a motor and held horizontal, the device bends along its axis of rotation because of its own weight. The more the device weighs and the longer it is, as determined by the number of balls and spindle lengths, the more it will bend along its axis of rotation. On the other hand, the longer the diameter of the spindles and the more rigid the spindles' material, the less the bend. For a device comprising of 3 hollow plastic baseball regulation size balls with plastic spindles, spindles of about ⅜ inch diameter will result in no visible bending.

3. Locations Where Spindles Meet Surfaces of Balls (Refer to FIG. 1 and FIG. 2)

Where a spindle 13 or 16 meets a ball's surface is a location that is specific and intended or purposeful. A location where a spindle 13 or 16 meets a ball's surface can be described by where that location is in relation to the ball's seams 11. Also a location where a spindle meets a ball's surface can be described by where that location is within the ball's covering material 12. The following are examples of two different specific locations where a spindle meets a ball's surface.

Figure 2:
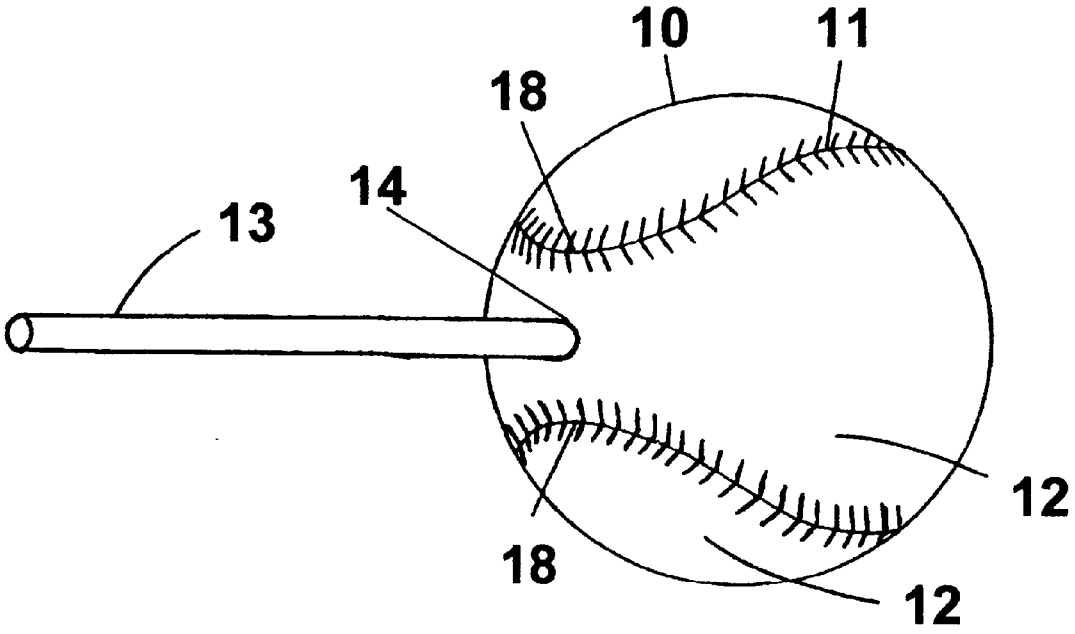
FIG. 2—Device with one Ball
Figure 3:
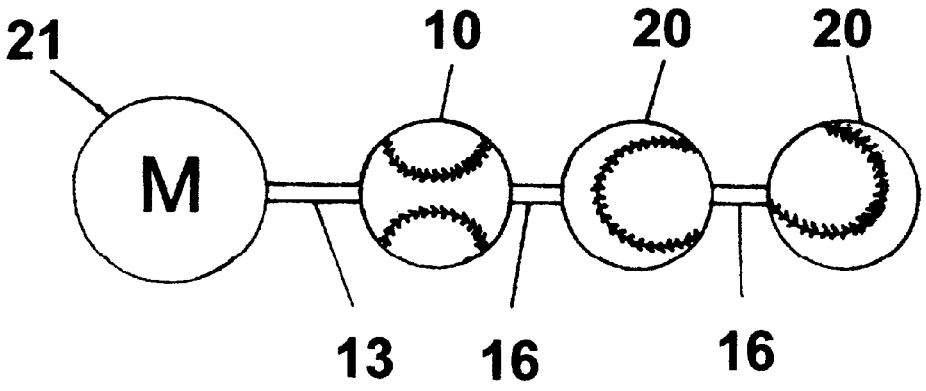
FIG. 3—Motor Connected to the Device

A spindle location of thrown against the seams is shown in FIG. 2 at 14. The ball shown in FIG. 2 has a spindle location of thrown against the seams. The following sentence is a description sufficient to describe a spindle location of thrown against the seams. Where a spindle joins the ball's surface is closest to a seam where the seams turn or change direction and is equally close to both members of a pair where seams turn or change direction 18. The following sentence is another description sufficient to describe a spindle location of thrown against the seams. The location where the spindle meets a ball's surface is at a most narrow width of the covering materials and is at the most narrow width's midpoint or center 19.

A spindle location of thrown with the seams is shown in FIG. 1 at 15. The ball shown on the left in FIG. 1 has a spindle location of thrown with the seams. The following three sentences are a description sufficient to describe a spindle location of thrown with the seams. For a spindle location of thrown with the seams, the midpoints or center of both the two most narrow width of covering material 19 are at equal distances from the ball's axis of rotation during the device's operation. These equal distances are a ball radius distance. In addition, where a spindle meets a ball's surface is an equal distance to the two closest seams to the spindle.

The following two sentences are another description sufficient to describe a spindle location of thrown with the seams. For a spindle location of thrown with the seams, each member of a pair where seams turn or change direction 18, is an equal distance away from the ball's axis of rotation during the device's operation. In addition, where a spindle meets a ball's surface is an equal distance to the two seams closest to the spindle.

4. Joining Balls and Spindles

Spindles are joined to balls so that the rotation generated by an electric motor can be transferred through the spindle to the balls. The preferred means to join all the spindles to balls is having the material of a spindle and the material of a ball the same and continuous (that is, without interruption). For example, this can be accomplished by forming a spindle and a ball in the same manufacturing step and using a material capable of being extruded or being molded.

5. Positioning of Balls and Spindles

Every spindle meets at least one ball's surface. If where each such meeting occurs, the spindles were to be extended sufficiently into the ball, the spindles would pass through the center of the ball that it meets. And because all spindles are straight and lie along one straight line, all spindles are along an axis going through the center of all the balls (See FIG. 1).

OPERATION OF THE INVENTION

The device's power transferring spindle is connected to an electric motor capable of inducing the same revolutions per minute as those of pitched baseballs (for example, an electric drill) if the power transferring spindle is not permanently connected. Because all locations where spindles meet the ball surfaces are specific and intended or purposeful, each ball of the device always spins with an intended axis of rotation.

For example, if the device has one or two spindles meeting the surface of the same ball at locations of thrown against the seams and one or two spindles meeting the surface of another ball at locations thrown with the seams, operation of the device will show both these two axes of rotation. The axis of rotation for one ball would be the same as if the ball had been gripped across its seams and then pitched. The axis of rotation for the other ball would be the same as if the ball had been gripped along its seams and then pitched.

The operator may have to tilt the axis of rotation of the device, so that it will be proper for a particular type of pitch or pitcher of interest. Because all spindles have been made inconspicuous, the tilt of the device's axis of rotation cannot be improperly ascertained by seeing a spindle. That is, if the electric motor is hidden from view. (The first paragraph in the section entitled SPINDLES describes what is meant by "inconspicuous".)

Holding the device in position, the operator turns the electric motor on. Because the spindles are joined to balls and the power transferring spindle is connected to an electric motor, the rotation generated by the motor is transferred to the balls. The device must also be held so that its spin direction as seen by the batter will be proper for a particular type of pitch. If the operator is using a variable speed motor, such as an electric drill, he operates the motor at a speed according to the type of pitch he is simulating. For example, curve balls spin more slowly than fast balls. One or more batters stand a distance away and practice seeing the spin created by the device operating.

Here are practical suggestions for operating the invention. Hiding the motor from view and choosing a background to make the spindles inconspicuous, forces the batter to ascertain the spin's axis of rotation and its tilt by reading only the ball's spin. Having the batter wear ear plugs to reduce motor sound, such sound capable of improperly revealing faster and slower revolution per minute of spins. Hiding from view those balls that are part of the device but not showing appropriate spins during particular operating conditions, could reduce distraction for the batter.

In summary, although all four defining characteristics of the spin of a pitched baseball can be created by operating the invention, only the axis of rotation is set by the invention itself. The tilt of that axis away from being parallel to the ground is adjusted by the operator tilting the invention. The revolutions per minute of the spin is adjusted by adjusting the motor speeds or changing motors. The spin direction is set by which direction the device points to.

WHY THE INVENTION WORKS

These are the reasons why this invention can provide a spin on a baseball appearing ball which has the same spin that a batter sees while looking at a pitched baseball.

1. The revolutions per minute of the spin on a pitched baseball is in the same range as the r.p.m. induced by common electric motors such as the motor and gear systems found in hand held electric drills. A 1959 paper by Lyman J. Briggs, in the *American Journal of Physics* p. 593, shows pitched ball spins range from 600 to 1600 r.p.m.
2. Baseball Hall of Fame member Rod Carew estimates that the spin of a pitched ball should be read within its first quarter of its flight. (Rod Carew, Art and Science of Hitting 49 (1986)). For the first quarter of the pitched ball's flight, the batter's perspective of the pitched ball spin remains almost the same. That is, both the side to side and up and down angles between the batter's line of sight and the direction of the ball changes insignificantly for the ball's first quarter of flight. This happens regardless of the batter being left handed or right handed facing a pitcher that is left handed or right handed, sidearm or overhand.

Thus, even though a spinning baseball created by this invention has no forward movement, the spin appears the same as a spin on a baseball that was pitched.

CONCLUSIONS AND SCOPE

The preferred embodiment described above will meet the objective. That objective is to create the spin of pitched baseballs, and to create the spins without having to pitch the balls.

The balls which are part of this invention have been described as having the surface appearance of a baseball. It is readily apparent that the invention could utilize a ball having the surface appearance of a softball and work equally well. A generic description which includes only a baseball and a softball is a seamed ball that is typically pitched. That is, baseballs and softballs are the two kinds of seamed balls that are typically pitched.

The balls of spinning baseball devices are not limited to a size which are the same size as a baseball or a softball. In order to utilize the invention at a closer distance to the batter than regulation distance thus saving practice space and to make the batter's viewing task equally challenging, the size of the balls of spinning baseball devices can be made smaller than regulations size baseballs or softballs. Therefore, this invention envisions balls smaller than regulation for practicing at close distances as well as regulation sizes for practicing at normal pitcher/batter distances. That is, this invention envisions balls no larger than regulation size.

This invention envisions additional specific locations where a spindle meets a ball's surface besides the two examples described above. Pitchers can grip a baseball in more ways than with the seams or against the seams. However, each location where a spindle meets a ball's surface is specific and purposeful or intended.

The preferred embodiment described the joining of spindles to balls by having spindle material and ball material the same and continuous. Spindles could also be joined to balls by having spindle material and ball material not continuous. That is, spindles could be made either to penetrate into balls or to be glued to balls. Each of the above are means to join spindles to balls.

When the preferred embodiment is used, different spins are displayed at the same time with the same motor (See FIG. 1). However, the axes of rotations on all the spins are displayed, but displayed at the same tilt away from being parallel to the ground. Therefore, this invention also envisions a device with one ball, which is connected to only one spindle, a power spindle (See FIG. 2). A one ball device is useful when the tilt on an axis of rotation is unique to one particular type of pitch or pitcher that is of interest.

Many people already own electric drills. Any electric drill made to drill holes has the minimal power to operate this device, whose only resistance to motor turning is the friction resulting from the device turning in the surrounding air. Therefore, a device that can utilize an electric drill as its electric motor can be made without an electric motor and at less cost. The power spindle of the preferred embodiment is of sufficient length and its diameter is sufficiently small so that it can be placed inside of and held tight by a chuck of an electric drill.

However, for those owners preferring to use a less noisy motor or a motor made for more continuous use than an electric drill, this invention envisions power spindles that connect to electric motors other than electric drills.

This invention also envisions electric motors made as part of the device for those owners not having an available motor. Any electric motor made to turn anything should have the minimal power to operate this device, whose only resistance to the motor turning is the friction resulting from the device turning in the surrounding air.

I claim:

1. A device rotated by an electric motor, to enable someone to practice recognizing types of spins common on pitched balls, but without having to pitch balls, said device comprising in combination:

a. a plurality of balls, each ball having the surface appearance of a seamed ball that is typically pitched, each said ball being no larger than the size of a seamed ball which is typically pitched and each said ball made of materials lightweight enough to prevent visible bending of the spindles when said device is operated with its spindles held horizontally, b. a power transferring spindle, joined to the one of said balls that is nearest an electric motor when said device is operated, and said power transferring spindle sized and shaped so that it can be connected to an electric motor, c. connecting spindles, numbering one less than the number of said balls, each said connecting spindle joined to two said balls with no said ball joined to more than two said connecting spindles, and d. joining means for spinning said balls and the spindles together as only one unit and all the spindles are straight and are inconspicuous and are positioned along an axis of rotation going through the centers of all said balls, and wherein all the spindles meeting said balls' surfaces at locations that are specific and intended in relation to said balls' seams.

2. The device in claim 1 wherein said power transferring spindle is of sufficient length and diameter of said power transferring spindle is sufficiently small so that said power transferring spindle can be placed inside of and held tightly by a chuck of an electric drill.

3. The device in claim 1 further including an electric motor, said electric motor connected to said power transferring spindle, said electric motor capable of rotating within the same revolutions per minute as those of seamed balls that are typically pitched.

4. The device in claim 1 wherein joining means for spinning said balls and the spindles together as only one unit having the material of the spindles and the material of the surfaces of the balls being the same and made in one piece.

5. The device in claim 4 wherein said power transferring spindle is of sufficient length and diameter of said power transferring spindle is sufficiently small so that said power transferring spindle can be placed inside of and held tight by a chuck of an electric drill.

6. The device in claim 4 further including an electric motor, said electric motor connected to said power transferring spindle, said electric motor capable of rotating within the same revolutions per minute as those of seamed balls that are typically pitched.

7. A device rotated by an electric motor, to enable someone to practice recognizing a type of spin common on pitched ball, but without having to pitch a ball, said device comprising in combination:

a. a ball having the surface appearance of a seamed ball that is typically pitched, said ball being no larger than the size of a seamed ball which is typically pitched and said ball made of materials lightweight enough to prevent visible bending of the spindle when said device is operated with its spindle held horizontally, b. a power transferring spindle which is straight and which is inconspicuous and which is positioned along an axis of rotation passing through the center of said ball, said power transferring spindle sized and shaped so that it can be connected to an electric motor, c. joining means for spinning said ball and said power transferring spindle together as only one unit, and d. said power transferring spindle meeting said ball's surface at a location that is specific and intended in relation to said ball's seams.

8. The device in claim 7 wherein said power transferring spindle is of sufficient length and diameter of said power transferring spindle is sufficiently small so that said power transferring spindle can be placed inside of and held tight by a chuck of an electric drill.

9. The device in claim 7 further including an electric motor, said electric motor connected to said power transferring spindle, said electric motor capable of rotating within the same revolutions per minute as those of seamed balls that are typically pitched.

10. The device in claim 7 wherein joining means for spinning said ball and said power transferring spindle together as only one unit having the material of the spindle and the material of the ball's surface being the same and made in one piece.

11. The device in claim 10 wherein said power transferring spindle is of sufficient length and diameter of said power transferring spindle is sufficiently small so that said power transferring spindle can be placed inside of and held tight by a chuck of an electric drill.

12. The device in claim 10 further including an electric motor, said electric motor connected to said power transferring spindle, said electric motor capable of rotating within the same revolutions per minute as those of seamed balls that are typically pitched.

* * * * *